US006390273B1

(12) United States Patent
Müller

(10) Patent No.: US 6,390,273 B1
(45) Date of Patent: May 21, 2002

(54) APPARATUS FOR DEFLECTING MASS FLOWS OF ROD-SHAPED ARTICLES

(75) Inventor: Thomas Müller, Börnsen (DE)

(73) Assignee: Hauni Maschinenbau Aktiengesellschaft, Hamburg (DE)

( * ) Notice: Subject to any disclaimer, the term of this patent is extended or adjusted under 35 U.S.C. 154(b) by 8 days.

(21) Appl. No.: 09/638,901

(22) Filed: Aug. 15, 2000

(30) Foreign Application Priority Data

Aug. 18, 1999 (DE) ..... 199 38 542

(51) Int. Cl.[7] ..... B65G 1/00
(52) U.S. Cl. ..... 198/347.1; 198/367
(58) Field of Search ..... 198/367, 347.1, 198/570, 577, 601; 414/403

(56) References Cited

U.S. PATENT DOCUMENTS

| | | | | |
|---|---|---|---|---|
| 3,526,904 A | | 9/1970 | Tamol | |
| 3,921,790 A | * | 11/1975 | Hinchcliffe et al. | 198/37 |
| 3,985,252 A | | 10/1976 | Hinchcliffe et al. | |
| 4,030,595 A | | 6/1977 | McCombie | |
| 4,099,608 A | | 7/1978 | McCombie | |
| 4,339,025 A | | 7/1982 | McCombie | |
| 5,106,254 A | | 4/1992 | Tolasch et al. | |
| 5,135,008 A | | 8/1992 | Oesterling et al. | |
| 5,472,078 A | | 12/1995 | Hoffmann et al. | |

FOREIGN PATENT DOCUMENTS

| | | |
|---|---|---|
| DE | 19 23 511 | 12/1970 |
| DE | 23 66 451 | 10/1973 |
| DE | 28 41 266 | 4/1980 |
| DE | 35 30 028 | 2/1987 |
| DE | 19 57 002 | 9/1990 |
| EP | 0 748 593 A1 | 12/1996 |
| FR | 2 298 282 | 1/1976 |
| GB | 1 276 493 | 6/1972 |
| GB | 2 062 567 | 5/1981 |

* cited by examiner

*Primary Examiner*—Kenneth W. Noland
(74) *Attorney, Agent, or Firm*—Venable; Robert Kinberg

(57) ABSTRACT

A horizontal belt conveyor delivers a mass flow of rod-shaped articles of the tobacco processing industry at a variable rate to a deflecting station where successive increments of the mass flow are caused to descend into an upright duct. The increments at the deflecting station are overlapped exclusively by two arcuate baffles which deflect the oncoming articles into the duct. The baffles are pivotable relative to each other about parallel axes and include intermeshing tongue-like end portions remote from the respective axes. A linkage couples the baffles to each other in such a way that any pivotal movements of one of the baffles entail predetermined movements of the other baffle.

20 Claims, 1 Drawing Sheet

APPARATUS FOR DEFLECTING MASS FLOWS OF ROD-SHAPED ARTICLES

CROSS-REFERENCE TO RELATED CASES

This application claims the priority of commonly owned German patent application Serial No. 199 38 542.4 filed Aug. 18, 1999. The disclosure of the above-referenced German patent application, as well as that of each U.S. and/or foreign patent and patent application identified in the specification of the present application, is incorporated herein by reference.

BACKGROUND OF THE INVENTION

The invention relates to improvements in apparatus for manipulating mass flows (multiple-layer flows) of elongated articles (particularly rod-shaped articles) which are to be advanced, by moving sideways, from one or more makers or other source or sources to one or more processing or consuming units (such as packing, filter tipping or other types of machines). Typical examples of elongated articles which are or must often be conveyed in the form of a mass flow are plain or filter cigarettes or other rod-shaped products of the tobacco processing industry. For example, it is frequently desirable to convey a mass flow of plain cigarettes from a maker (e.g., a machine known as PROTOS which is distributed by the assignee of the present application) to a so-called tipping machine wherein pairs of plain cigarettes of unit length are assembled with filter mouthpieces of multiple unit length to form therewith filter cigarettes of double unit length. A tipping machine of such character is known as MAX and is distributed by the assignee of the present application. Reference may also be had to commonly owned U.S. Pat. No. 5,135,008 granted Aug. 4, 1992 to Oesterling et al. for "METHOD OF AND APPARATUS FOR MAKING FILTER CIGARETTES".

It is often necessary (e.g., due to the configuration and/or the dimensions of the space which is available for the installation of a mass flow conveying unit) to deflect the mass flow, once or more than once, on its way from a source to a processing station. This involves the establishment of mutually inclined first and second paths and of a deflecting station between the two paths. The instrumentalities at the deflecting station serve to direct successive increments of the mass flow from one of the paths into the other path, e.g., from the discharge end of a substantially horizontal path into the upper end of a downwardly extending upright path. As a rule, a cover is provided to at least partially overlie those increments of the mass flow which advance through or along the deflecting station. The cover is designed with a view to ensure that it is capable of "breathing", i.e., of expanding and contracting in dependency upon the fluctuations of quantities of articles in those portions of the mass flow which are in the process of advancing through the deflecting station. The present invention relates to improvements in the just described apparatus which are designed to convey a mass flow from a first path, through a deflecting station, and into a second path which is inclined relative to the first path.

In accordance with a prior proposal, plain or filter cigarettes are conveyed from a maker or from a tipping machine to a packing machine in the form of a mass flow along a normally horizontal first path, through a deflecting station, and into a downwardly extending second path which compels the cigarettes to descend into a magazine of the packing machine. A collapsible cover at the deflecting station comprises several cigarette-contacting baffles as well as one or more additional cigarette-contacting parts.

German patent No. 36 30 028 discloses an apparatus which is designed to change the direction of movement of a mass flow of cigarettes through 90° on their way into a so-called tray filling machine, e.g., a machine disclosed in commonly owned U.S. Pat. No. 5,106,254 granted Apr. 21, 1992 to Tolasch et al. for "APPARATUS FOR FILLING AND EMPTYING TRAYS FOR ROD-SHAPED ARTICLES OF THE TOBACCO PROCESSING INDUSTRY". The apparatus of the German patent employs a "breathing" cover which overlies the topmost layer of articles at the deflecing station and comprises a membrane which is attached to two carriers pivotable about discrete neighboring axes. When the articles of the mass flow pile up at the inlet (upper end) of the upright path serving to receive articles which have advanced through the deflecting station, the topmost layer of the articles at such station causes the membrane to yield and to penetrate into a reservoir. Such yielding of the membrane entails a pivoting of the aforementioned carriers. A drawback of the just described patented apparatus is that the useful life of the membrane is rather short as well as that the reservoir constitutes a bulky component which occupies a substantial amount of space at the deflecting station irrespective of whether or not it is in use, i.e., whether or not it receives a portion of the membrane and a certain quantity of rod-shaped articles at the deflecting station. Moreover, the articles which have entered the reservoir are likely to dwell therein for extended periods of time.

Another conventional deflecting apparatus is disclosed in published German patent application Serial No. 28 41 266. This apparatus serves to convey a mass flow of cigarettes along a horizontal path to a level above the magazine of a packing machine. The cover for the cigarettes at the deflecting station above the magazine employs a membrane which is attached to a single carrier. The arrangement is such that the carrier is connected to one side of the membrane at the receiving (upstream) end of the deflecting station; the other side of the membrane (at the downstream end of the deflecting station) is attached to a spring which causes the underside of the membrane to bear upon the topmost layer of the mass flow between the upstream and downstream ends of the deflecting station. In the event of a pileup at the discharge end of the deflecting station (i.e., at the upper end of the duct discharging into the magazine of the packing machine), the topmost layer of cigarettes bears upon the underside of the membrane which yields against the opposition of the aforementioned spring. A sensor which overlies the membrane detects such displacement of the membrane and generates a signal which is used to vary the speed of a prime mover (such as a motor) serving to regulate the speed of the conveyor which delivers successive increments of the mass flow along the horizontal path and to the inlet of the deflecting station. A drawback of the just described deflecting apparatus is that it employs a membrane, i.e., a cover the useful life of which is relatively short, as well as that the spring-biased membrane is apt to deform the adjacent cigarettes when it is called upon to yield due to a pileup of cigarettes at the inlet of the aforementioned duct.

OBJECTS OF THE INVENTION

An object of the instant invention is to provide a deflecting apparatus which can treat the rod-shaped articles of a mass flow of such articles gently and which is provided with a novel and improved cover for the topmost layer of articles advancing through the deflecting station between an article-delivering first conveyor and an article-receiving second conveyor.

Another object of the invention is to provide an apparatus which constitutes an improvement over and a further development of deflecting apparatus disclosed in German patent No. 35 30 028.

A further object of the present invention is to provide a deflecting apparatus which need not employ a membrane as a cover or as a part of the cover for rod-shaped articles at the deflecting station.

An additional object of the invention is to provide a machine or production line which employs the improved deflecting apparatus.

Still another object of the invention is to provide a deflecting apparatus which is simpler and more compact than presently known deflecting apparatus for successive increments of mass flows of cigarettes and analogous rod-shaped articles.

A further object of the invention is to provide an apparatus which can be readily installed in existing machines or production lines as a superior substitute for conventional deflecting apparatus.

Another object of the invention is to provide a deflecting apparatus which is constructed and assembled in such a way that the deforming forces applied to the topmost layer of rod-shaped articles at the deflecting station remain at least substantially constant irrespective of fluctuations of the rate of delivery of the articles of a mass flow to and/or of the rate of removal of articles from the deflecting station.

An additional object of the invention is to provide an apparatus which is particularly suited for controlled advancement and deflection of mass flows of plain or filter cigarettes or analogous rod-shaped smokers' products from a maker to a processing or consuming unit because it can manipulate rod-shaped smokers' products without causing the escape of any or any appreciable quantities of tobacco particles at the tobacco containing end(s) of the rod-shaped products.

Still another object of the present invention is to provide a novel and improved method of manipulating rod-shaped articles of a mass flow of such articles at a station where successive increments of the mass flow are being deflected from a first path (such as a substantially horizontal path into a second path (such as a substantially vertical path).

A further object of the invention is to provide a novel and improved cover which can be utilized in the above outlined deflecting apparatus to overlie the top-most layer of rod-shaped articles in that increment or in those increments of a mass flow of rod-shaped articles which advance through the deflecting station.

SUMMARY OF THE INVENTION

One feature of the present invention resides in the provision of an apparatus for deflecting successive increments of a mass flow of at least substantially parallel elongated rod-shaped articles from a first path wherein the articles are advanced sideways in a first direction into a second path wherein the articles are advanced sideways in a second direction inclined with reference to the first direction and receiving articles from the first path at a deflecting station. The improved apparatus comprises a first conveyor having means (such as one or more endless belts or bands or chains) for advancing successive increments of the mass flow along the first path to the deflecting station, a second conveyor (e.g., an upright chute or duct) defining the second path and having means (such as the sidewalls surrounding the second path) for receiving successive deflected increments of the mass flow at the deflecting station, and means for diverting successive increments of the mass flow during advancement from the first path into the second path. The diverting means consists essentially of a plurality of (preferably two) mobile plate-like baffles overlying the increments of the mass flow at the deflecting station. The baffles can be said to constitute a collapsible and expandible (breathing) cover which overlies the increments of the mass flow at the deflecting station irrespective of variations of the rate of advancement of rod-shaped articles along the first path to the deflecting station and/or the rate of entry of deflected increments of articles into the second path.

At least one of the baffles is or can be pivotable relative to the conveyors. The arrangement is preferably such that each of the baffles is pivotable relative to the conveyors about a discrete axis which is remote from at least one of the conveyors; the at least one conveyor is or can be constituted by the first conveyor, and the pivot axes of the baffles are or can be at least substantially parallel to each other.

The improved cover at the deflecting station is or can be set up in such a manner that it includes a first baffle pivotable relative to the conveyors about a first axis which is disposed at the inlet of the deflecting station (i.e., at the inlet of that portion of the composite path for the mass flow which extends through the deflecting station), and a second baffle pivotable relative to the conveyors about a second axis disposed at the outlet of the deflecting station. In accordance with a presently preferred embodiment, the first baffle is pivotable about the first axis in a first region and the second baffle is pivotable about the second axis in a second region which at least partially overlaps or coincides with the first region. Otherwise stated, the mobile baffles of the novel cover are movable relative to the first and second conveyors in regions which at least partially overlap or coincide with each other.

The baffles are movable relative to the two conveyors as well as relative to each other and they can include portions (e.g., comb-like portions or toothed portions) which intermesh at least during one or more predetermined stages of movement of the baffles relative to each other.

At least one of the baffles can constitute an arcuate (e.g., a concavo-convex) plate which extends along a 45° arc forming part of a circle having its center remote from the respective pivot axis.

The baffles can be provided with rounded end portions which are remote from the respective pivot axes and are or can be parallel to the rod-shaped articles at the deflecting station; such end portions are movable relative to each other and they can constitute the aforediscussed serrated or toothed portions of the respective baffles.

The first conveyor can be arranged to advance a substantially horizontal mass flow having a height which is variable between a maximum height and a minimum height, and each of the baffles can be mounted for pivotal movement about a discrete axis. Each such baffle can have a length (as measured radially of the respective pivot axis) which at least approximates the maximum height of the mass flow (i.e., the height of the first path as measured at right angles to the direction of advancement of successive increments of the mass flow along the first path).

In accordance with an additional feature of the invention, the apparatus can further comprise means (such as a linkage) for articulately coupling the baffles to each other. For example, if the baffles include first and second baffles which are respectively pivotable about first and second axes, the coupling means can comprise first and second levers which are respectively pivotable with the first and second baffles and at least one link which connects the levers to each other. The arrangement is or can be such that each of the two ends of the link is articulately connected to the free end of a single lever. If the first and second axes are respectively adjacent the first and second paths, the first lever can be mounted in such a way that it is at least substantially parallel to the adjacent portion of the first baffle and the second lever can be mounted in such a way that it is at least substantially normal to the adjacent portion of the second baffle.

The first conveyor is or can be adjustable to vary the rate of advancement of rod-shaped articles of the mass flow along the first path, and such apparatus can further comprise means for adjusting the first conveyor in dependency on the extent of movement of at least one of the baffles from a predetermined starting position.

The first path is or can be at least substantially horizontal, and the second path is or can be at least substantially vertical and preferably extends downwardly from the deflecting station.

The purpose of the aforediscussed coupling means is to ensure that, when one of the baffles is moved by the rod-shaped articles advancing through the deflecting station from a predetermined (e.g., a starting) position in response to fluctuations in the rate of advancement of articles to the deflecting station by the first conveyor, the other baffle or baffles is or are moved to an extent which is a function of the extent of movement of the one baffle from its predetermined position.

A presently preferred use of the improved deflecting apparatus is in a production line wherein the first conveyor receives rod-shaped articles of the tobacco processing industry from a maker of such articles. e.g., in a production line including the structure described and shown in commonly owned U.S. Pat. No. 5,472,078 granted Dec. 5, 1995 to Hoffmann et al. for "METHOD OF AND APPARATUS FOR CONVERTING A SINGLE LAYER OF ROD-SHAPED ARTICLES INTO A MASS FLOW".

The novel features which are considered as characteristic of the invention are set forth in particular in the appended claims. The improved apparatus itself, however, both as to its construction and the modes of assembling and operating the same, together with additional important and advantageous features and attributes thereof, will be best understood upon perusal of the following detailed description of certain presently preferred specific embodiments with reference to the accompanying drawings.

DESCRIPTION OF PREFERRED EMBODIMENTS

Figure 2:
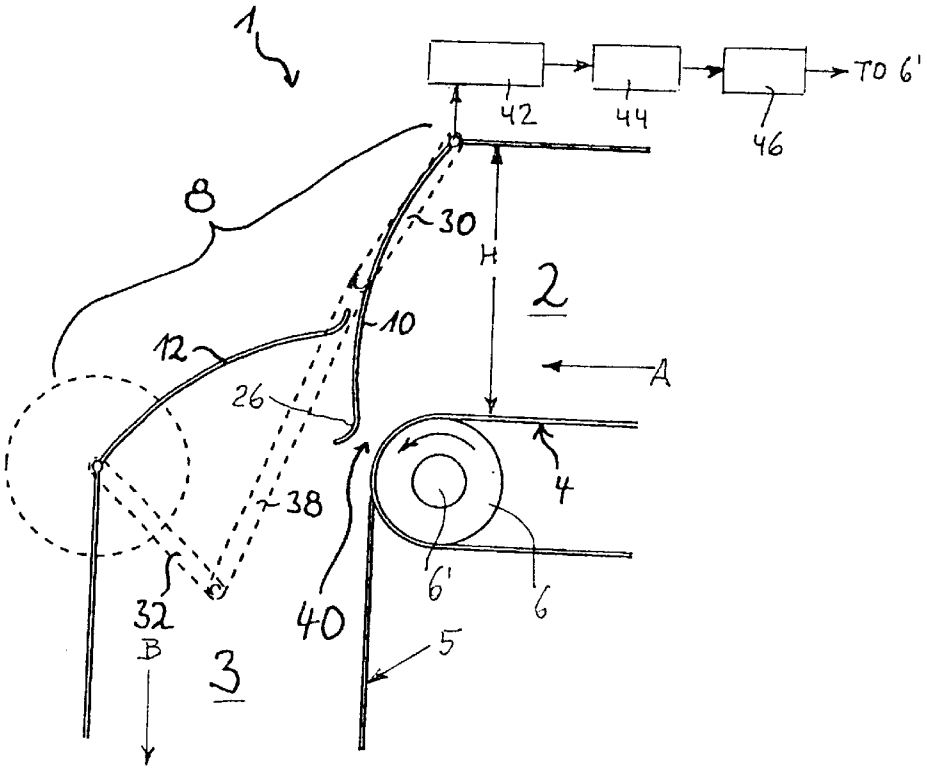
FIG. 2 illustrates the structure of FIG. 1 but with the baffles shown in different positions relative to each other.

The deflecting apparatus 1 of FIG. 1 comprises a first conveyor 4 serving to advance a mass flow (not shown) of rod-shaped articles (hereinafter called cigarettes for short but with the understanding that the apparatus can manipulate a wide variety of normally circular elongated rod-shaped articles which can be assembled into a mass flow) sideways along a horizontal first path 2 into the inlet or receiving end of an arcuate deflecting station 8. The outlet of the station 8 is located above the upper (intake) end of an upright second conveyor 5 in the form of a duct which defines a downwardly extending second path 3 discharging, for example, into the magazine of a cigarette packing machine.

The manner in which a series of successive cigarettes issuing from one or more makers can be assembled into a mass flow which is caused to advance along a horizontal path is disclosed, for example, in the aforementioned U.S. '078 patent to Hoffmann et al. A packing machine which can receive cigarettes supplied by the second conveyor 5 is distributed by the assignee of the present application and is known as COMPAS.

The horizontal path 2 (wherein successive increments of the mass flow of parallel cigarettes advance in the direction of arrow A) is bounded in part by fixed sidewalls 2' and in part by the horizontal upper reach or stretch 2" of an endless belt or band forming part of the conveyor 4 and being trained over several pulleys or sheaves one of which is shown at 6. One of the pulleys (e.g., the illustrated pulley 6) is driven by the rotary output element 6' of a variable-speed prime mover 46 (see FIG. 2), e.g., an electric motor or a transmission receiving torque from such motor.

The second conveyor 5 confines successive increments of the mass flow in the path 3 to gravity induced movement in the direction of arrow B and includes stationary upright sidewalls 3' which surround the path 3 and extend upwardly preferably to the level of the axis of the output element 6'. The arcuate deflecting station 8 has its center on or close to the axis of the output element 6' and extends along an arc of 90°. The outer side of the arcuate path which extends between the straight paths 2 and 3 is bounded by a novel and improved cover which is capable of "breathing" and consists essentially of two arcuate plate-like baffles 10 and 12. The baffle 10 is installed upstream of the baffle 12 and is pivotable about the horizontal axis of a pintle which forms part of a hinge 20 having a first section affixed to the adjacent front end 18 of the upper horizontal wall 2' and a second section affixed to the adjacent rear end portion 14 of the baffle 10. The pintle of the hinge 20 articulately connects the two sections to each other and is located at the inlet or receiving end of the station 8, i.e., substantially at a locus above the axis of the pulley 6. The hinge 24 which articulately connects the lower end portion 16 of the downstream baffle 12 to the upper end portion 22 of adjacent upright wall 3' has a pintle which is parallel to the pintle of the hinge 20 and is located at the level of the axis of the pulley 6.

Each of the concavo-convex baffles 10, 12 extends along an arc of approximately or exactly 45° as seen in the circumferential direction of an imaginary cylindrical body having a center coinciding with the center of curvature of the arcuate surface including the concave inner side or the convex outer side of the baffle. Thus, the baffles 10, 12 can assume angular positions in which they jointly form a composite cover extending along an arc of 90° from the hinge 20 to the hinge 24, i.e., from the inlet to the outlet of the deflecting station 8.

Figure 1:
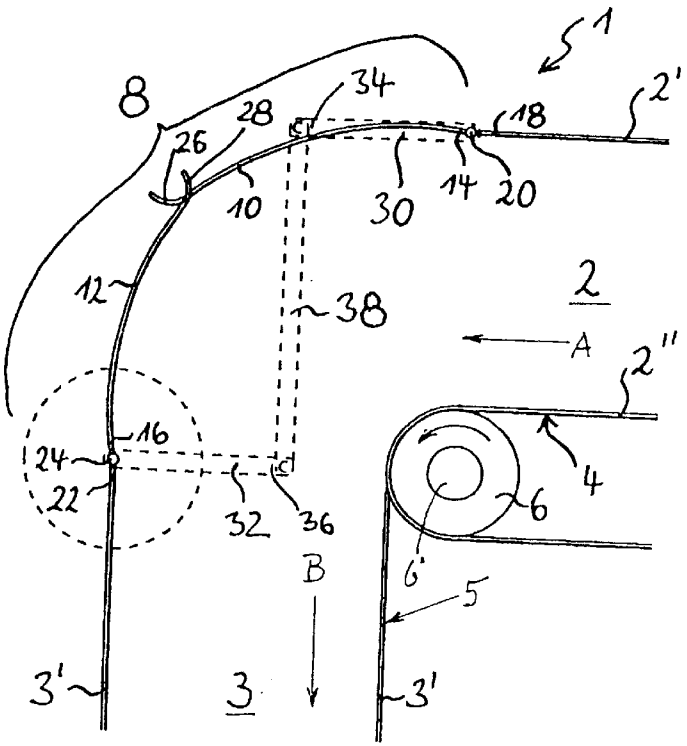
FIG. 1 is a fragmentary schematic elevational view of an apparatus which embodies one form of the invention, the mobile baffles of the diverting means being shown in first positions relative to each other.

The free end portions 26, 28 of the respective baffles 10, 12 are rounded and mate or mesh with each other when the baffles assume the angular positions shown in FIG. 1. Such meshing is possible because the end portions 26, 28 are toothed or pronged and their teeth or prongs are positioned and distributed in such a way that they can bypass each other while the baffles 10, 12 move toward or away from the angular positions of FIG. 1. Otherwise stated, a portion of the space or region covered by the baffle 10 during pivoting about the axis of the hinge 20 is common to a portion of the space or region covered by the baffle 12 while it pivots about the axis of the hinge 24.

The deflecting apparatus 1 further comprises a novel and improved coupling or linkage which establishes an articulate connection between the baffles 10 and 12. In other words, each angular displacement (or at least certain angular displacements) of the baffle 10 about the axis of the hinge 20 entails or entail a predetermined angular displacement of the baffle 12 about the axis of the hinge 24 and vice versa. The coupling which is shown in FIGS. 1 and 2 comprises a first lever 30 which is compelled to pivot with and is substantially parallel to the adjacent portion of the baffle 10, a second lever 32 which is compelled to pivot with and is substantially parallel to the adjacent portion of the baffle 12, and an elongated rigid link 38 having a first end portion articulately connected (at 34) with the free end of the lever 30 and a second end portion articulately connected (at 36) with the free end portion of the lever 32.

The baffles 10, 12 assume the angular positions of FIG. 1 when the height of the mass flow in the path 2 assumes a maximum value H (see FIG. 2) i.e., when the topmost layer of cigarettes being supplied by the first conveyor 4 is close to or actually contacts the horizontal top wall 2' for such path. It is further assumed that the path 3 is unobstructed, i.e., that the second conveyor or duct 5 can accept successive increments of the mass flow a the rate at which they enter the vertical inlet and leave the horizontal outlet of the arcuate path which is located at the concave inner sides of the baffles 10 and 12. In other words, the mass flow constitutes a moving multiple-layer body of cigarettes which fills the paths 2, 3 as well as the deflecting station 8.

If the height of the mass flow in the path 2 decreases (e.g., due to a reduction of the output of the maker which supplies cigarettes onto the upper reach 2" of the endless belt forming part of the conveyor 4), for example, in a manner as disclosed in the aforementioned U.S. '078 patent to Hoffmann et al., the baffle 10 is free to pivot counterclockwise toward or even beyond the angular position of FIG. 2. This causes the coupling including the parts 30, 32, 38 to pivot the baffle 12 clockwise toward or even beyond the angular position shown in FIG. 2.

When the baffles 10, 12 assume the angular positions of FIG. 2, their outwardly rounded free end portions 26, 28 no longer intermesh and are located nearer to the pulley 6. The path for the advancement of the reduced mass flow from the path 2 into the path 3 is then established by the narrow clearance or channel 40 between the free end portion 26 of the baffle 10 and the pulley 6.

The baffles 10, 12 can also assume angular positions which are shown in FIG. 2 if the rate at which the duct 5 delivers cigarettes to a packing or another consuming or processing machine increases beyond that which is required to ensure that each increment of a mass flow having the maximum height H and advancing along the path 2 is allowed to advance through the deflecting station 8 and to enter the upper end of the downwardly extending second path 3.

The parts 30, 32, 38 of the coupling (linkage) between the baffles 10, 12 are shown by broken lines because they are assumed to be located in front of or behind the deflecting station 8. Such mounting of the coupling ensures that its constituents cannot interfere with the advancement of successive increments of the mass flow through the deflecting station 8 and/or in the discharge end of the horizontal path 2 and/or in the receiving end of the vertical path 3.

The baffle 10 assumes the angular position of FIG. 2 when it is required to practically interrupt the advancement of successive increments of the mass flow from the path 2, via passage 40, and into the path 3. Such situation arises or can develop when the rate of delivery of cigarettes by the first conveyor 4 is reduced to a fraction of the maximum rate. If the rate of delivery of cigarettes by the conveyor 4 thereupon increases, the front face of the increased mass flow in the path 2 bears upon the concave inner side of the baffle 10 and pivots the latter (at 20) clockwise back toward the angular position of FIG. 1. Such pivoting of the baffle 10 causes the coupling including the parts 30, 32, 38 to pivot the baffle 12 counterclockwise, i.e., back toward the angular position of FIG. 1. Thus, the composite cover consisting of the two pivotable baffles 10, 12 can "breathe", i.e., its position, effective size and configuration can automatically conform to the required or desired rate of advancement of cigarettes from the path 2 into the path 3. Such "breathing" of the novel cover can take place without the need to employ a membrane and/or resilient means for biasing the cover against the exposed layer of cigarettes advancing through the deflecting station 8.

The effective length of the baffle 10 can match or approximate the maximum height H of the path 2, and the effective length of the baffle 12 can match or approximate the width of the top portion of the path 3.

An important advantage of the improved deflecting apparatus 1 is that it is effective not only when the rates of delivery and removal of cigarettes are optimal, e.g., when the height of the mass flow in the path 2 equals H and the duct 5 is capable of accepting successive increments of the mass flow at the rate they are being delivered into the receiving end or inlet of the deflecting station 8, but also under numerous other circumstances of use. Thus, if the height of the mass flow in the path 2 decreases well below the maximum value H (e.g., to a height which entails a pivoting of the baffle 10 from the angular position of FIG. 1 to that shown in FIG. 2), i.e., when the rate of delivery of cigarettes to the station 8 drops below the rate of admission of cigarettes into the duct 5, the apparatus 1 continues to ensure that the novel cover overlies the cigarettes which are exposed at the deflecting station. In other words, the changes (if any) of the rate of delivery of cigarettes by the conveyor 4 into the deflecting station 8 do not or need not entail any, or any pronounced, shifting of cigarettes relative to each other within the advancing mass flow. This is important during the next-following increase of the rate of delivery of cigarettes by the conveyor 4, i.e., during an increase of the height of the mass flow in the path 2. Such increase of the rate of delivery of cigarettes by the conveyor 4 does not result in deformation or squashing of cigarettes in the mass flow increments approaching the deflecting station 8. In other words, the improved apparatus 1 (and more particularly or especially the novel cover at the deflecting station) ensures that the number of rejects need not increase when the rate of delivery of cigarettes forming the mass flow in the path 2 increases or decreases in actual use of the deflecting apparatus.

The baffles 10, 12 can constitute lightweight arcuate plate-like metallic or plastic bodies which can be pivoted in response to the application of relatively small forces. Thus, the baffle 10 can yield and pivot from the angular position of FIG. 2 back to that shown in FIG. 1 in response to the application of a relatively small force by the cigarettes at the front end of the increasing mass flow in the path 2. Consequently, such pivoting of the baffle 10 (and the resulting automatic pivoting of the baffle 12 by the coupling including the parts 30, 32, 38) does not result in deformation or destruction of the cigarettes which actually pivot the baffle 10 and/or of the immediately following column or columns of superimposed cigarettes. The cigarettes of the rising mass flow in the path 2 need not actually lift but merely pivot the baffle 10. It has been found that the magnitude of the force exerted by the cigarettes of the rising mass flow in the path 2 can be maintained at a highly satisfactory (i.e., low) value if the baffles 10, 12 are mounted in a manner as actually shown in FIGS. 1 and 2. Thus, the baffle 10 is installed to pivot about a first horizontal axis (defined by the hinge 20) which is adjacent the inlet of the deflecting station 8, and the baffle 12 is pivotable about a second horizontal axis which is parallel to the first axis, which is defined by the hinge 24, and which is located at the outlet of the station 8.

An advantage of the feature that the free end portions 26, 28 of the baffles 10, 12 intermesh in certain angular positions of the baffles relative to each other is that the concave sides of the baffles can jointly provide a continuous surface which guides all of the oncoming cigarettes of the mass flow in the path 2 and compels them to advance through the deflecting station 8 and into the upper end of the path 3 in an optimum manner which is least likely to result in jamming of the station 8 and/or in deformation of, or even greater damage to, the cigarettes travelling sideways from the path 2 toward and into the path 3.

The baffles 10, 12 are even more capable of treating the cigarettes advancing through the station 8 gently if their effective lengths are properly related to the extent of desired deflection. Thus, and since the path 3 extends at right angles to the path 2, successive increments of the mass flow must change the direction of their advancement through an angle of 90°. Therefore, and as already mentioned hereinbefore, each of the concavo-convex baffles 10, 12 preferably extends along an arc of 45°, i.e., along one-eighth of a complete circle. This enables such baffles to jointly provide a composite concave surface which, in normal operation of the deflecting apparatus 1 (as shown in FIG. 1), extends along an arc of 90°. Such dimensioning of the baffles contributes significantly to gentle treatment of the cigarettes advancing through the deflecting station 8.

An advantage of the feature that the free end portions 26, 28 of the baffles 10, 12 are curved outwardly (i.e., away from the adjacent layer of cigarettes advancing through the deflecting station 8) is that the inner sides of such baffles can establish a composite guide surface which does not interfere with the advancement of immediately adjacent cigarettes toward the path 3 in a large number of different angular positions of the baffles. This holds true even when the angular positions of the baffles are such (see FIG. 2) that only one of the baffles is in actual contact with the cigarettes advancing through the deflecting station 8. Thus, even when the baffles assume positions which greatly depart from the desired or optimum positions corresponding to or approximating those shown in FIG. 1, they are still capable of ensuring that the orientation of cigarettes in those increments of the mass flow which advance through the station 8 remains unchanged and that such cigarettes are not subjected to pronounced or excessive stresses which could affect their shape and/or integrity.

The coupling including the parts 30, 32, 38 ensures that one of the two baffles 10, 12 assumes an optimum angular position in response to a change in the angular position of the other baffle and vice versa. In the illustrated deflecting apparatus, the coupling is designed to ensure that angular positions of the downstream baffle 12 depend upon the angular positions of the upstream baffle 10. Thus, and since the baffle 10 is being directly acted upon by the leading end of the mass flow in the path 2, the baffle 12 is caused to automatically conform its angular position to each newly selected or imposed angular position of the baffle 10. Accordingly, neither of the two baffles is likely to adversely influence, or is even capable of adversely influencing, the conditions and/or appearances of adjacent cigarettes irrespective of the angular positions of the baffles relative to each other and/or relative to the conveyor 4 and/or 5. Moreover, the coupling including the parts 30, 32, 38 is capable of ensuring gradual (smooth) changes in the angular positions of the baffle 12 in response to changes of the angular positions of the baffle 10.

The coupling including the parts 30, 32, 38, the aforedescribed mode of attaching the parts 30, 32, 38 to each other, the aforedescribed mode of attaching the parts 30, 32 to the respective baffles 10, 12, and the aforedescribed mode of orienting the parts 30, 32 relative to the respective baffles constitute an optional but highly effective and desirable feature of the invention. The coupling can be readily designed and installed in such a way that it compels the baffles 10, 12 to assume optimal angular positions relative to each other as well as relative to the conveyors 4, 5 during each stage of operation of the improved deflecting apparatus and irrespective of the rate at which the transport of successive increments of the mass flow is altered from the delivery or large quantities of cigarettes per unit of time to the delivery of small or minimal quantities, or vice versa. Moreover, the upstream baffle 10 can be caused to assume an angular position (beyond that shown in FIG. 2) in which it seals the discharge end of the path 2 from the inlet of the deflecting station 8. The mass flow (if any) which is then confined in the path 2 can begin to advance into the station 8 as soon as the force exerted by cigarettes on the conveyor 4 upon the concave side of the baffle 10 suffices to pivot the baffle 10 clockwise; this takes place without adversely affecting the mutual positioning and orientation of cigarettes constituting the mass flow in the path 2.

The coupling including the parts 30, 32, 38 is preferably designed, assembled and linked to the baffles 10, 12 in such a way that the baffle 12 can overlie the trailing (upper) end of the mass flow in the path 3 or, at the very least, seal the path 3 from the discharge end or outlet of the deflecting station 8 when the delivery of cigarettes from the interior of the station 8 into the path 3 is interrupted. In other words, the coupling can completely seal the path 2 and/or the path 3 from the interior of the deflecting station 8, preferably in automatic response to those changes (including interruptions) of delivery of cigarettes into and evacuation of cigarettes from the station 8 which render such sealing advisable or necessary. This mode of operation of the coupling has been found to be highly desirable and advantageous because it at least greatly reduces the likelihood of damage to (deformation and/or destruction of) the cigarettes during normal operation of the deflecting apparatus, during changes in the rate of advancement of cigarettes from the path 2 into the path 3, as well as when the mass flow in the path 2 and/or 3 is at a standstill.

The aforediscussed orientations of the levers 30, 32 relative to the adjacent portions of the baffles 10, 12, and the aforedescribed articulate connections 34, 36 between the free ends of the levers 30, 32 on the one hand and the respective end portions of the rigid link 38 on the other hand, have been found to ensure a highly satisfactory coordination between the pivotal movements of the baffle 10 and those of the baffle 12. Suitable adjustments of the parts 30, 32, 38 of the coupling will be carried out if the apparatus is to serve as a means for deflecting the mass flow through an angle other than 90°.

The improved deflecting apparatus is preferably provided with means for automatically adjusting the rate of delivery of cigarettes to the deflecting station 8 in response to changes in the angular position of at least one of the baffles 10, 12. Thus, the speed of the output element 6' of the prime mover 46 which drives the pulley 6 of the conveyor 4 can be varied as a function of the extent of pivotal movement of the baffle 10 and/or 12 about the pintle of the respective hinge 20, 24. FIG. 2 shows schematically a sensor 42 which monitors the angular positions of the baffle 10, and a control circuit 44 which processes the signals furnished by the sensor 42 and transmits appropriate signals to the adjustable prime mover 46 which regulates the RPM of the output element 6' in dependency upon changes of characteristics of signals being furnished by the sensor 42. Such signals denote the quantity of cigarettes in the path defined by the deflecting station 8 and being overlapped by the "breathing" cover composed of the baffles 10 and 12. The signals from the sensor 42 also indicate the rate of evacuation of cigarettes from the station 8 into the path 3 since such rate also influences the angular position of the baffle 10 and hence also of the baffle 12.

For example, if the rate of evacuation of cigarettes from the path 3 into the magazine of a consumer increases because the requirements of the consumer have increased for any one of a plurality of reasons, the baffles 10, 12 pivot from the positions of FIG. 1 toward the positions of FIG. 2. The control circuit 44 ascertains whether or not the station 8 is empty or is about to become empty. The circuit 44 then adjusts the prime mover 46 in a sense to increase the speed of the conveyor 4 in order to replenish the supply of cigarettes at the station 8.

The length of the baffle 10 (as measured radially of the axis of the hinge 20) preferably equals or approximates the maximum height H of the mass flow in the path 2, and the length of the baffle 12 (as measured radially of the axis of the hinge 24) preferably equals or approximates the width of the path 3, i.e., the maximum transverse dimension of the mass flow descending below the station 8. Such dimensioning of the baffles renders it possible to seal (when necessary) the inlet of the station 8 from the path 2 and/or the outlet of the station 8 from the path 3 in a simple, reliable, re-producible and efficient manner.

The improved deflecting apparatus is susceptible of numerous additional modifications without departing from the spirit of the invention. For example, the number of baffles can be increased to more than two and the baffles can be operatively connected to each other by a different linkage or by a coupling wherein the linkage is replaced by gears, rack-and-pinion units and/or other suitable motion transmitting parts. Furthermore, the speed of the output element 6' can be regulated in response to signals furnished by a sensor which monitors the angular positions of the baffle 12 or by a control system receiving signals from several sensors, e.g., one for each pivotable baffle.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of the above outlined contribution to the art of manipulating mass flows of plain or filter cigarettes or the like and, therefore, such adaptations should and are intended to be comprehended within the meaning and range of equivalence of the appended claims.

What is claimed is:

1. Apparatus for deflecting successive increments of a mass flow of at least substantially parallel rod-shaped articles from a first path wherein the articles are advanced sideways in a first direction into a second path wherein the articles are advanced sideways in a second direction inclined with reference to the first direction and receiving articles from the first path at a deflecting station, comprising:

a first conveyor having means for advancing successive increments of the mass flow along said first path to said station;

a second conveyor defining said second path and having means for receiving successive deflected increments of the mass flow at said station; and means for diverting successive increments of the mass flow during advancement from said first path into said second path, said diverting means consisting essentially of a plurality of mobile baffles overlying the increments of the mass flow at said station.

2. The apparatus of claim 1, wherein said baffles together constitute a collapsible and expandible cover which overlies the increments of the mass flow at said station irrespective of variations of the rate of advancement of articles along said first path to said deflecting station.

3. The apparatus of claim 1, wherein at least one of said baffles is pivotable relative to said conveyors.

4. The apparatus of claim 3, wherein each of said baffles is pivotable relative to said conveyors about a discrete axis which is remote from at least one of said conveyors.

5. The apparatus of claim 4, wherein said at least one conveyor is said first conveyor and said axes are at least substantially parallel to each other.

6. The apparatus of claim 1, wherein said deflecting station has an article receiving inlet and an article discharging outlet, said baffles including a first baffle pivotable relative to said conveyors about a first axis disposed at said inlet and a second baffle pivotable relative to said conveyors about a second axis disposed at said outlet.

7. Apparatus for deflecting successive increments of a mass flow of at least substantially parallel rod-shaped articles from a first path wherein the articles are advanced sideways in a first direction into a second path wherein the articles are advanced sideways in a second direction inclined with reference to the first direction and receiving articles from the first path at a deflecting station, comprising:

a first conveyor having means for advancing successive increments of the mass flow along said first path to said station;

a second conveyor defining said second path and having means for receiving successive deflected increments of the mass flow at said station; and means for diverting successive increments of the mass flow during advancement from said first path into said second path, said diverting means consisting essentially of a plurality of mobile baffles overlying the increments of the mass flow at said station, wherein said deflecting station has an article receiving inlet and an article discharging outlet, said baffles including a first baffle pivotable relative to said conveyors about a first axis disposed at said inlet and a second baffle pivotable relative to said conveyors about a second axis disposed at said outlet, wherein said first baffle is pivotable about said first axis in a first region and said second baffle is pivotable about said second axis in a second region at least partially overlapping said first region.

8. The apparatus of claim 1, wherein said first path is at least substantially horizontal and said second path is at least substantially vertical and extends downwardly from said deflecting station.

9. The apparatus of claim 1, wherein said first conveyor is arranged to receive rod-shaped articles of the tobacco processing industry from a maker of rod-shaped articles.

10. Apparatus for deflecting successive increments of a mass flow of at least substantially parallel rod-shaped articles from a first path wherein the articles are advanced sideways in a first direction into a second path wherein the articles are advanced sideways in a second direction inclined with reference to the first direction and receiving articles from the first path at a deflecting station, comprising:

a first conveyor having means for advancing successive increments of the mass flow along said first path to said station;

a second conveyor defining said second path and having means for receiving successive deflected increments of the mass flow at said station; and means for diverting successive increments of the mass flow during advancement from said first path into said second path, said diverting means consisting essentially of a plurality of mobile baffles overlying the increments of the mass flow at said station, wherein said mobile baffles are movable relative to said conveyors in regions which at least partially overlap each other.

11. The apparatus of claim 10, wherein said baffles are movable relative to each other and include portions which intermesh at least during predetermined stages of movement of said baffles relative to each other.

12. The apparatus of claim 10, wherein at least one of said baffles extends along a 45° arc forming part of a circle.

13. The apparatus of claim 10, wherein said baffles have rounded end portions movable toward and away from each other.

14. Apparatus for deflecting successive increments of a mass flow of at least substantially parallel rod-shaped articles from a first path wherein the articles are advanced sideways in a first direction into a second path wherein the articles are advanced sideways in a second direction inclined with reference to the first direction and receiving articles from the first path at a deflecting station, comprising:

a first conveyor having means for advancing successive increments of the mass flow along said first path to said station;

a second conveyor defining said second path and having means for receiving successive deflected increments of the mass flow at said station; and means for diverting successive increments of the mass flow during advancement from said first path into said second path, said diverting means consisting essentially of a plurality of mobile baffles overlying the increments of the mass flow at said station, wherein said first conveyor is arranged to advance a substantially horizontal mass flow having a height which is variable between a maximum height and a minimum height, said baffles being pivotable relative to said conveyors about discrete axes and each of said baffles having a length, as measured radially of the respective axis, which at least approximates said maximum height.

15. Apparatus for deflecting successive increments of a mass flow of at least substantially parallel rod-shaped articles from a first path wherein the articles are advanced sideways in a first direction into a second path wherein the articles are advanced sideways in a second direction inclined with reference to the first direction and receiving articles from the first path at a deflecting station, comprising:

a first conveyor having means for advancing successive increments of the mass flow along said first path to said station;

a second conveyor defining said second path and having means for receiving successive deflected increments of the mass flow at said station;

means for diverting successive increments of the mass flow during advancement from said first path into said second path, said diverting means consisting essentially of a plurality of mobile baffles overlying the increments of the mass flow at said station; and means for articulately coupling said baffles to each other.

16. The apparatus of claim 15, wherein said baffles include first and second baffles respectively pivotable about first and second axes and said coupling means comprises first and second levers respectively pivotable with said first and second baffles and at least one link connecting said levers with each other.

17. The apparatus of claim 16, wherein said at least one link is articulately connected with at least one of said levers.

18. The apparatus of claim 16, wherein said first and second axes are respectively adjacent said first and second paths, said first lever being at least substantially parallel an adjacent portion of said first baffle and said second lever being at least substantially normal to an adjacent portion of said second baffle.

19. Apparatus for deflecting successive increments of a mass flow of at least substantially parallel rod-shaped articles from a first path wherein the articles are advanced sideways in a first direction into a second path wherein the articles are advanced sideways in a second direction inclined with reference to the first direction and receiving articles from the first path at a deflecting station, comprising:

a first conveyor having means for advancing successive increments of the mass flow along said first path to said station;

a second conveyor defining said second path and having means for receiving successive deflected increments of the mass flow at said station; and means for diverting successive increments of the mass flow during advancement from said first path into said second path, said diverting means consisting essentially of a plurality of mobile baffles overlying the increments of the mass flow at said station, wherein said first conveyor is adjustable to vary the rate of advancement of articles along said first path, and further comprising means for adjusting said first conveyor as a function of the extent of movement of at least, one of said baffles from a predetermined starting position.

20. Apparatus for deflecting successive increments of a mass flow of at least substantially parallel rod-shaped articles from a first path wherein the articles are advanced sideways in a first direction into a second path wherein the articles are advanced sideways in a second direction inclined with reference to the first direction and receiving articles from the first path at a deflecting station, comprising:

a first conveyor having means for advancing successive increments of the mass flow along said first path to said station;

a second conveyor defining said second path and having means for receiving successive deflected increments of the mass flow at said station; and means for diverting successive increments of the mass flow during advancement from said first path into said second path, said diverting means consisting essentially of a plurality of mobile baffles overlying the increments of the mass flow at said station, wherein one of said baffles is movable by the articles at said deflecting station from a predetermined position in response to fluctuations of advancement of articles to said station by said first conveyor, and further comprising means for moving another of said baffles as a function of the extent of movement of said one baffle from said predetermined position.

* * * * *